US008431824B1

(12) United States Patent
King, Jr. et al.

(10) Patent No.: US 8,431,824 B1
(45) Date of Patent: Apr. 30, 2013

(54) DIRECT BURY SPLICE KITS

(75) Inventors: L. Herbert King, Jr., Jupiter, FL (US); William Hiner, O'Fallon, MO (US); James Keeven, O'Fallon, MO (US)

(73) Assignee: The Patent Store LLC, O'Fallon, MO (US)

( * ) Notice: Subject to any disclaimer, the term of this patent is extended or adjusted under 35 U.S.C. 154(b) by 332 days.

(21) Appl. No.: 12/807,294

(22) Filed: Sep. 1, 2010

(51) Int. Cl.
*H01R 4/00* (2006.01)
*H01R 4/12* (2006.01)

(52) U.S. Cl.
USPC ..... 174/84 R

(58) Field of Classification Search ..... 174/84 R
See application file for complete search history.

(56) References Cited

U.S. PATENT DOCUMENTS 3,781,461 A * 12/1973 Thompson et al. ..... 174/93
3,823,254 A * 7/1974 Smith ..... 174/92
3,934,076 A * 1/1976 Smith ..... 174/87
4,783,227 A * 11/1988 Meador ..... 156/49
4,839,473 A * 6/1989 Fox et al. ..... 174/138 F
5,023,402 A * 6/1991 King et al. ..... 174/87
5,038,003 A * 8/1991 Allec et al. ..... 174/138 F
5,099,088 A * 3/1992 Usami et al. ..... 174/76
5,113,037 A * 5/1992 King et al. ..... 174/87
5,252,779 A * 10/1993 DiRienzo ..... 174/87
5,382,756 A * 1/1995 Dagan ..... 174/92
5,962,811 A * 10/1999 Rodrigues et al. ..... 174/76
6,025,559 A * 2/2000 Simmons ..... 174/87
6,294,737 B1 * 9/2001 Chestney ..... 174/74 R
6,628,880 B2 * 9/2003 Roberts ..... 385/135
6,739,906 B2 * 5/2004 Lawrence et al. ..... 439/521
6,958,449 B1 * 10/2005 Ziebart et al. ..... 174/84 R
7,170,005 B1 * 1/2007 King et al. ..... 174/84 R
7,368,663 B1 * 5/2008 Fisher et al. ..... 174/74 R
2005/0118851 A1 * 6/2005 King et al. ..... 439/276
2006/0191705 A1 * 8/2006 King et al. ..... 174/87
2008/0108241 A1 * 5/2008 Kocher et al. ..... 439/345
2008/0236863 A1 * 10/2008 King et al. ..... 174/92
2011/0143565 A1 * 6/2011 King et al. ..... 439/171

* cited by examiner

*Primary Examiner* — Timothy Thompson
*Assistant Examiner* — Nathan Milakovich
(74) *Attorney, Agent, or Firm* — Jacobson & Johnson LLC

(57) ABSTRACT

A direct bury kit having an elongated housing having a chamber for inserting a wire connector therein with the housing and the cover each having at least one jaw to clamp a portion of a wire against the jaws to thereby inhibit or prevent disruption of an electrical connection while maintaining the electrical connection in a waterproof condition.

18 Claims, 5 Drawing Sheets

DIRECT BURY SPLICE KITS

FIELD OF THE INVENTION

This invention relates generally to direct bury electrical connectors and, more specifically, to direct bury splice kits having jaws for preventing disruption of a wire connection located therein.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of waterproof twist-on wire connectors wherein a sealant is placed in the cavity of a twist-on wire connector is known in the art and is shown in U.S. Pat. Nos. 5,113,037; 5,023,402 and 5,151,239. In these type of connectors the wires are inserted through a pierceable cover and into a sealant in the twist-on wire connector cavity. In some embodiments sleeves are placed on the wire connector to contain extra sealant. In a further embodiment the connector includes clips for looping the wires thereon to prevent the wires from pulling out of the twist-on wire connector.

A system widely used in installing underground electrical systems, is known as a direct bury splice kit. The kit includes, a twist-on wire connector, a housing with an integral cover that is closeable on the wires to provide stain relief. One such kit is sold by the 3M electrical products of Austin Tex. The kit comprises a twist-on wire connector that contains no sealant and an elongated tube that contains a sealant. The twist-on wire connector and the tube are both stored loosely in a plastic package that must be breached before the twist-on wire connector and the elongated tube can be used. The elongated tube contains a sealant in a closed end of the tube and a cover proximate an open end of the tube. The cover can be closed which extends a dome between the wires extending into the tube to force the wires against a side wall of the housing.

U.S. Pat. No. 7,170,005 shows a twist-on wire connector that is an integral part of a one-piece tube, which eliminates the handling of a separate wire connector. The tube also includes a dome for extending into the tube to force the wires against the tube side walls.

Although the above prior art connectors work well for maintaining wires in a waterproof connection a pulling forces on the wires during the burying of the splice kit has the potential to dislodge the electrical connection between the wires joined therein. The invention descried herein inhibits or prevents disruption an electrical connection formed in the tubular housing.

SUMMARY OF THE INVENTION

A direct bury splice kit including an elongated housing having a chamber for inserting a wire connector therein and a lateral wire cradle together with a cover having at least one jaw to clamp a portion of a wire against the wire cradle through a direct or indirect clamping force to the wire to thereby inhibit or prevent loosing of the an electrical wire connection while maintaining the electrical wire connection between the ends of wires in a waterproof condition in the chamber.

DESCRIPTION OF THE PREFERRED EMBODIMENT

Figure 1:
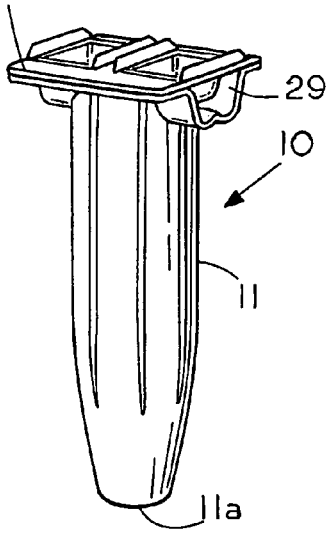
FIG. 1 is a perspective view of a direct bury splice kit.
Figure 2:
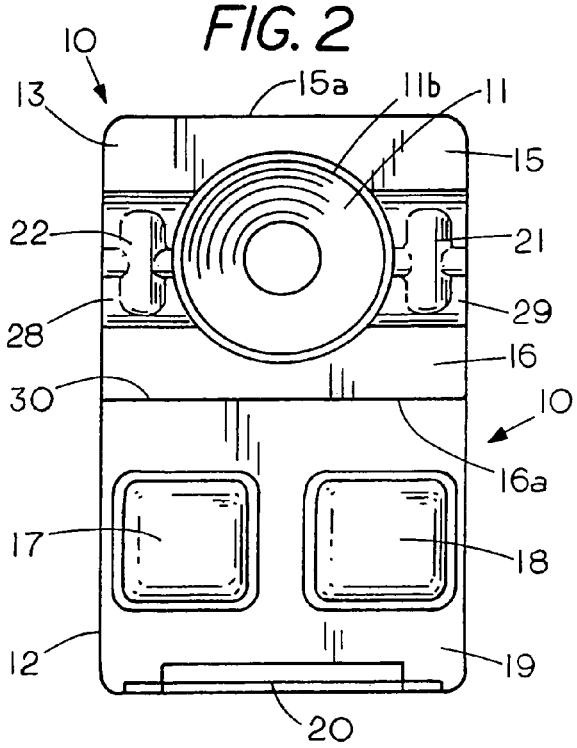
FIG. 2 is a top view of the direct bury splice kit of FIG. 1 in an open condition.

FIGS. 1 to 5 illustrate an example of a direct bury splice kit 10. FIG. 1 is a perspective view of a direct bury splice kit 10 which is used to waterproof a wire connection located therein. The splice kit 10 includes an elongated tubular housing 11 having a closed end 11*a* and an open-end 11*b* (FIG. 2) for receiving a twist-on wire connector. A hinged cover 12, which is pivotally secured to housing 11, allows one to close the open-end 11*b* of housing 11. FIG. 1 shows the cover 12 in a closed condition while FIG. 2 shows a top view of tubular housing 11 with cover 12 in an open condition. Tubular housing 11 includes a lateral cantilevered ledge 15 and a lateral cantilevered ledge 16 that extend outwardly from opposite sides of tubular housing 11. Ledge 15 is cantilevered outward in a direction normal to a central axis of the tubular housing 11 with an outer edge 15*a* in an unattached or free condition while ledge 16 is also cantilevered outward in a direction normal to a central axis of the tubular housing 11 with an outer edge 16*a* having the cover 12 secured thereto through a living hinge 30.

Cover 12 includes a first square shaped compressible jaw 17 and a second square shaped compressible jaw 18 which are integrally formed as a bubble or protrusion in cover 12. Cover 12 and tubular housing 11 are made from an electrically insulating material such as a polymer plastic. In the example shown a living hinge 30 connects cover 12 to ledge 16 to allow pivoting the cover 12 from an open condition shown in FIG. 4 to a closed condition shown in FIG. 5. While a living hinge is shown it should be understood that other types of hinges may be used without departing from the spirit and scope of the invention. While a hinged cover is shown it is envisioned that other types of covers including separate covers which are secured to the housing may be used without departing from the spirit and scope of the invention.

Extending between one side of ledge 15 and ledge 16 is a first wire cradle 29 and located on the opposite side of tubular housing and extending between ledge 15 and ledge 16 is a second wire cradle 28. As shown in the drawings wire cradle 29 and wire cradle 28 have a "w" shape to form side by side channels to accommodate two separate wires, however, wire cradle 29 or wire cradle 28 may contain more or less channels without departing from the spirit and scope of the invention.

Extending transversely in wire cradle 29 is a compressible jaw 21 that extends upward from wire cradle 29 and similarly located transversely in wire cradle 28 is a compressible jaw 22 that extends upward from wire cradle 28. Compressible jaw 22 and 21 are resiliently deformable to simultaneously deform around and frictional secure a wire therein as clamping pressure is exerted on a wire through the compressible jaws.

Figure 5:
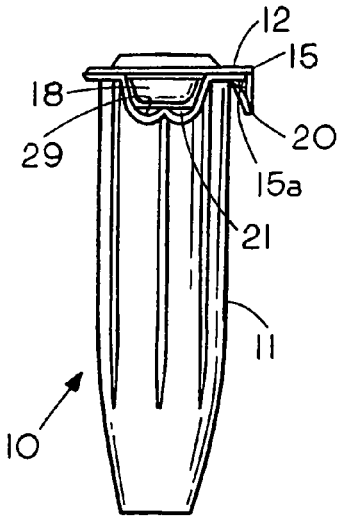
FIG. 5 is a side view of the direct bury splice kit of FIG. 1 in a closed condition.

Compressible jaw 22 is positioned to one side of tubular housing 11 and similarly compressible jaw 17 is positioned on one side of cover 12 so that when cover 12 is brought into a closed condition, as shown in FIG. 5, the compressible jaws 17 and 22 are aligned with each other to enable the compressible jaw 22 and compressible jaw 17 to exert a normal force to clamp a wire therebetween. Similarly, compressible jaw 21 is positioned to an opposite side of tubular housing 11 while compressible jaw 18 is also positioned on an opposite side of tubular housing 12 so that when the cover 12 is brought into closed condition the compressible jaw 18 is an alignment with compressible jaw 21 to exert a normal force to clamp a wire therebetween. In the example of FIG. 2 the compressible jaw 21 and 22 are integrally formed from bubbles or protrusions extending from the respective wire cradles although other types of the compressible or non compressible jaws may be used without departing from the spirit and scope of the invention described herein.

Figure 4:
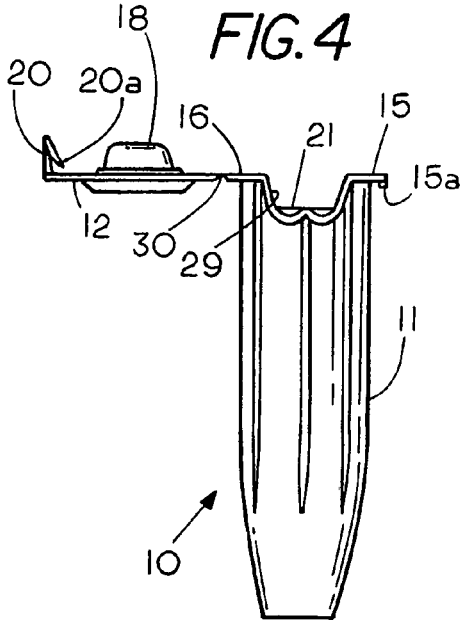
FIG. 4 is a side view of the direct bury splice kit of FIG. 1 in an open condition.

FIG. 4 shows the direct bury kit 10 in an open condition without a wire connection secured therein. Cover 12 includes a resilient latch 20 with a lip 20*a* for engaging the underside 15*a* of ledge 15 when the cover 12 is pivoted to the closed condition. FIG. 5 illustrates the cover 12 in the closed condition with the latch 20 secured to the ledge underside 15*a* to hold the cover in the closed condition when the direct bury splice kit 10 is buried.

Figure 1A:
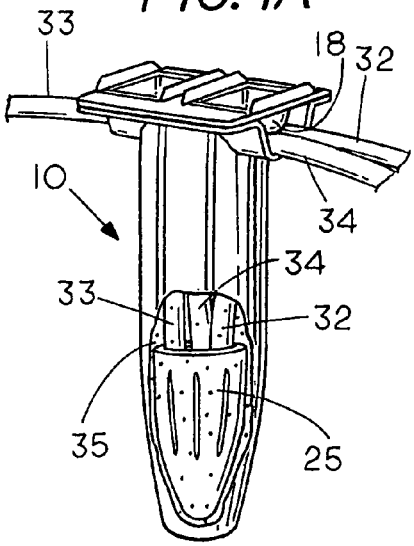
FIG. 1A a perspective view of a direct bury splice kit of FIG. 1 with a set of wires secured therein.
Figure 2A:
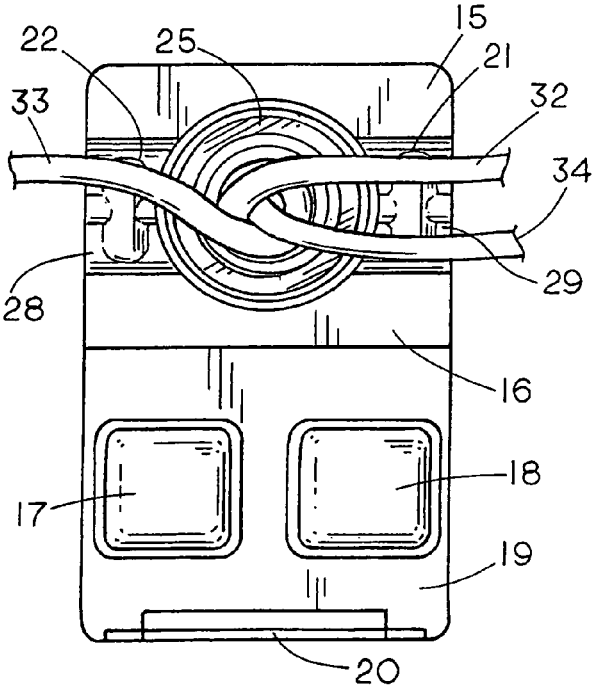
FIG. 2A is a top view of the direct bury splice kit of FIG. 1 in an open condition with a set of wires located therein.

FIG. 1A shows a perspective view of a direct bury splice kit 10 with tubular housing 11 in partial section to reveal the presence of a twist-on wire connector 25 having wires 32 and 33 and 34 joined therein. In addition a sealant 35 is present in tubular housing 11 with the sealant encapsulating the twist-on wire connector and the electrical junction therein. FIG. 1A and FIG. 2A show the wires 32 and 34, which are joined in connector 25 extend in an axial direction along tube 11 and then make a right angle to extend transversely outward between cover 12 and wire cradle 29. With the cover 12 in the condition shown in FIG. 1A the deformable jaw 21 supports the under side of wire 32 and wire 34 while the deformable jaw 18 exerts a clamping force on the top of wires 32 and 34 to frictionally hold wires 32 and 34 between the opposed jaws. Similarly, the deformable jaw 22 supports the underside of wire 33 while the deformable jaw 17 exerts a clamping force on top of wire 33 to frictionally hold wire 33 between the opposed jaws. In the example shown the wires 32 and 34 rest in the w-shaped wire cradle 29 to laterally confine wires 32 and 34 therein. Similarly, wire 33 rests in the w-shaped wire cradle 28 to laterally confine wire 33 therein. In this example the forces are directed normal to the electrical wires to clamp the wires therebetween.

Figure 3:
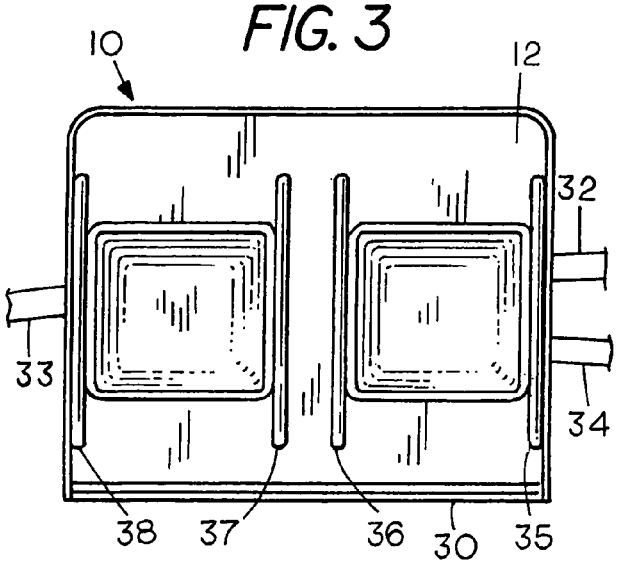
FIG. 3 is a top view of the direct bury splice kit of FIG. 1A in a closed condition.

FIG. 3 shows a top view of cover 12 in the closed condition with the wires 32,33 and 34 frictional held in position to inhibit or prevent disturbance to an electrical connection joined in the twist-on wire connector 25 located in tubular housing 11. To waterproof the connection therein a sealant 35 such as silicone sealant or the like is placed in tube 11 to encapsulate the end of the wire connector 25 as well as the ends of wires 32,33 and 34 joined therein as illustrated in FIG. 1A. Although a twist-on wire connector is shown in an encapsulated condition other connectors may be used including but not limited to split bolt connectors, push in connectors, lug connectors as well as soldered wire ends. A set of cover reinforcing ribs 35,36,37 and 38 extend partially across cover to provide reinforcement to cover 12.

Thus as described above the invention includes a method of making a direct bury electrical connection that inhibits or prevents disruption of an electrical connection by joining an end of each of a set of electrical wires 32,33 and 34 in a twist-on electrical wire connector 25 followed by encapsulating the electrical connector 25 in a tube of sealant 38 while extending the set of wires out of the open end of tube 11. The wires 32, 33 and 34 are either bent into a wire cradle 29 or a wire cradle 28 which extends laterally outward from the tube 11 of sealant. One can then engage an underside of each of wires in a portion of the wire that is located in the wire cradle 28 or 29 with a jaw located thereunder and a jaw located in cover 12 to inhibit or prevent disruption of an electrical connection in the electrical wire connector 25.

FIG. 2A shows a top view similar to FIG. 2 except wires 32,33 and 34 are located in a twist-on wire connector 25, which is located in tube 11.

Figure 2B:
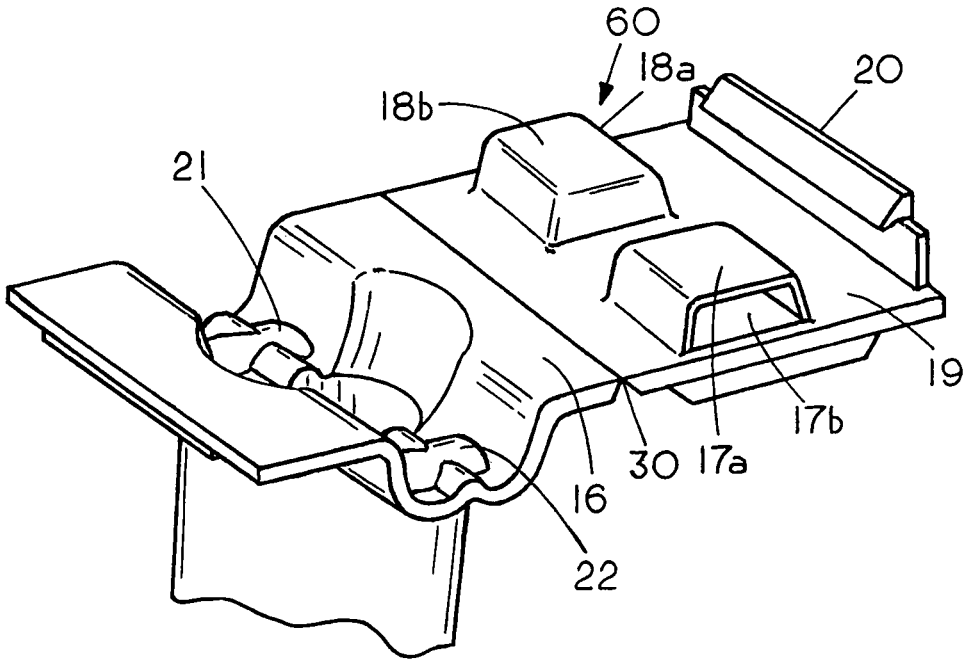
FIG. 2B is a perspective view of the direct bury splice kit having jaws with an open side.

FIG. 2B shows another example of direct bury splice kit 60 with like members having identical numbers as their counterparts in FIG. 1 and FIG. 2. The direct bury splice kit 60 differs from the direct bury splice kit 10 in that the bubble like closed compressible jaw 17 has been replaced with an open compressible jaw 17*a* having a side opening 17*b* therein. The removal of a side portion of the compressible jaw allows for one to adjust the compressive force exerted by jaw 17*a* when the jaw engages a wire thereunder. Similarly, the bubble like compressible jaw 18 has been replaced with a open compressible jaw 18*a* having a side opening 18*b* therein. The removable of a side portion of the compressible jaw allows for one to change the compressive force exerted on the jaw 18*a* when the jaw engages a wire thereunder. Thus a feature of the invention is the use of either closed or open resiliently deformable jaws, which can allow one to selective control the force exerted on a wire as the compressible jaws clampingly engage a wire thereunder. While the compressible jaws 17 and 18 in the cover 12 are shown as either open or closed compressible jaws the jaws 21 or 22 may also be open compressible jaws if so desired. It is envisioned that in some cases rigid jaws may be preferred for clamping the wire therebetween rather than compressible jaws.

FIG. 1A and FIG. 2A illustrates the step of clamping the portion of the wires that are located in the wire cradle 28 between a resiliently deformable jaw 22 and a resiliently deformable jaw 17 and the portion of the wires that are located in the wire cradle 29 between a resiliently deformable jaw 21 and a resiliently deformable jaw 18. Thus in use of the direct bury splice kit 10 the method may include the step of engaging a top side of the portion of the wires of each of the wires 32,33, and 34 with a jaw to clamp each of the wires therebetween. While compressible jaws are shown in the cover and wire cradle in some applications one may prefer to have rigid jaws in both the cover and the wire cradle for clamping a wire therebetween.

Figure 6:
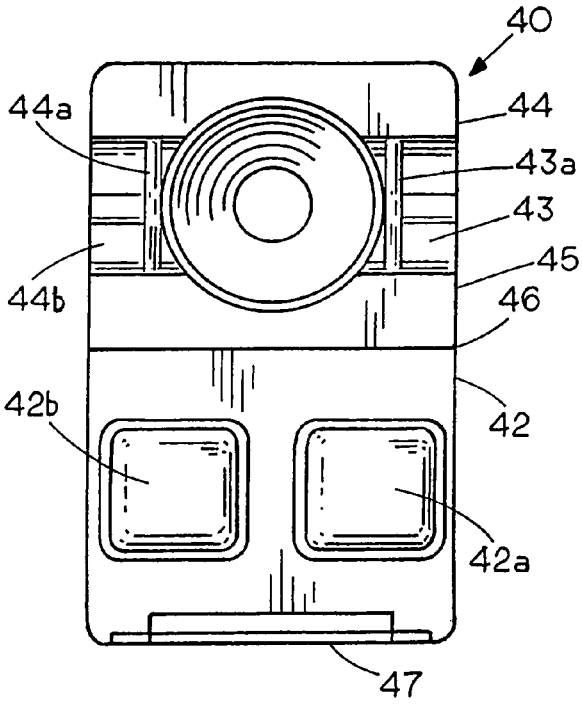
FIG. 6 is a top view of another embodiment of a direct bury splice kit in an open condition.
Figure 7:
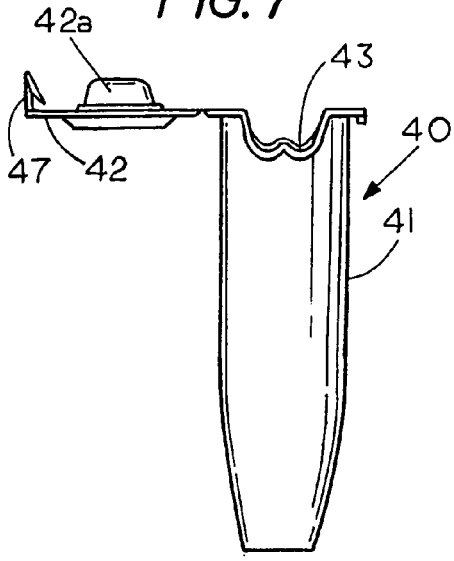
FIG. 7 is a side view of the embodiment of a direct bury splice kit of FIG. 6 in an open condition.
Figure 8:
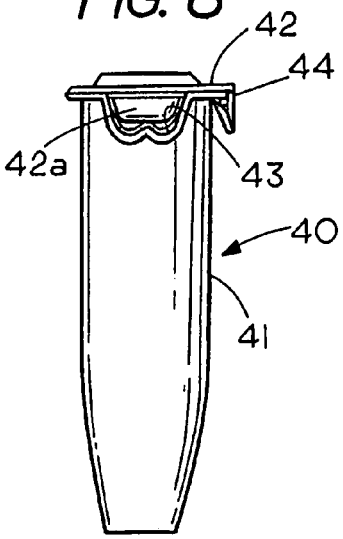
FIG. 8 is a side view of the embodiment of a direct bury splice kit of FIG. 6 in a closed condition.

FIG. 6, FIG. 7 and FIG. 8 show another example of a direct bury splice kit 40. Direct bury splice kit 40 includes a tubular housing 41 with FIG. 7 showing cover 42 in an open condition. Tubular housing 41 includes a lateral cantilevered ledge 45 and a lateral cantilevered ledge 44 that extend outwardly from opposite sides of tubular housing 41. Ledge 45 is cantilevered outward in a direction normal to a central axis of the tubular housing with an outer edge in an unattached or free condition while ledge 45 is also cantilevered outward in a direction normal to a central axis of the tubular housing 41 with an outer edge having the cover 42 secured thereto through a living hinge 46. Although the ledges are shown extending normal to a central axis of the housing the ledges may extend in a non-normal direction from a central axis of the housing without departing from the spirit and scope of the invention.

Cover 42, which is similar to cover 12, includes a first square dome shaped compressible jaw 42*b* and a second dome square shaped compressible jaw 42*a* each of which are integrally formed as a bubble or protrusion in cover 42. Cover 42 and tubular housing 41 are made from an electrically insulating material such as a polymer plastic. In the example shown a living hinge 46 connects cover 42 to ledge 45 to allow pivoting the cover 42 from an open condition shown in FIG. 7 to the to a closed condition shown in FIG. 8.

Extending between one side of ledge 44 and ledge 45 is a first wire cradle 43 and located on the opposite side of tubular housing 41 and extending between ledge 45 and ledge 44 is a second wire cradle 44*b*. Wire cradle 43 and wire cradle 44*b* have a "w" shape to form side by side channels to accommodate two separate wires, however, wire cradle 43 or wire cradle 44*b* may contain more or less channels without departing from the spirit and scope of the invention.

Extending transversely in wire cradle 43 is an elongated rib or rigid jaw 43*a* that extends upward from wire cradle 43 and similarly located transversely in wire cradle 44*b* is an elongated rib or rigid jaw 44*a* that extends upward from wire cradle 44*b*. In contrast to the compressible jaw 22 and 21 in cover 22 of direct bury splice kit 10 the jaws 43*a* and 44*a* are rigid to resist deformation.

FIG. 6 shows that compressible jaw 42*a* is positioned to one side of cover 42 and similarly compressible jaw 42*b* is positioned on the opposite side of cover 42 so that when cover 42 is brought into a closed condition, as shown in FIG. 8, the compressible jaw 42*b* and rigid jaw 44*a* are aligned with each other to enable the compressible jaw 42*b* and rigid jaw 44*a* to clamp a wire therebetween as a normal force is exerted against the wire. Similarly, rigid jaw 43*a* is positioned to an opposite side of tubular housing 41 while compressible jaw 42*a* is also positioned on an opposite side of tubular housing 41 so that when the cover 42 is brought into closed condition the compressible jaw 42*a* is an alignment with rigid jaw 43*a* to clamp a wire therebetween as a normal force is exerted against the wire. In the example of FIG. 6 the compressible jaw 42*b* and 42*a* are integrally formed from bubbles or protrusions extending from the respective wire cradles although other types of the compressible jaws may be used without departing from the spirit and scope of the invention described herein. Similarly, rigid jaws 43*a* and 44*a* are each integrally formed as a massive rib that extends from side to side of the respective cradles.

Figure 9:
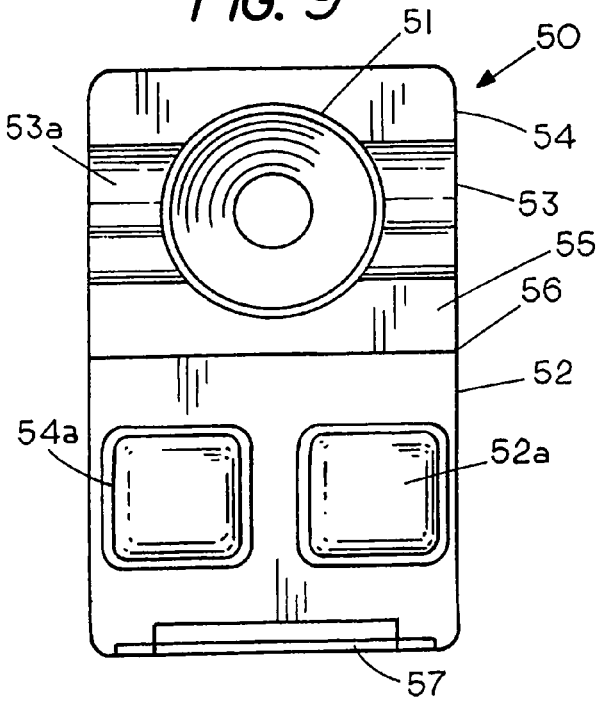
FIG. 9 is a top view of another embodiment of a direct bury splice kit in an open condition.
Figure 10:
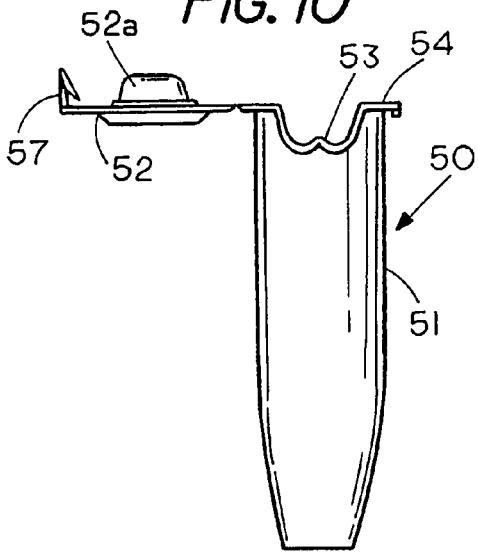
FIG. 10 is a side view of the embodiment of a direct bury splice kit of FIG. 9 in an open condition.
Figure 11:
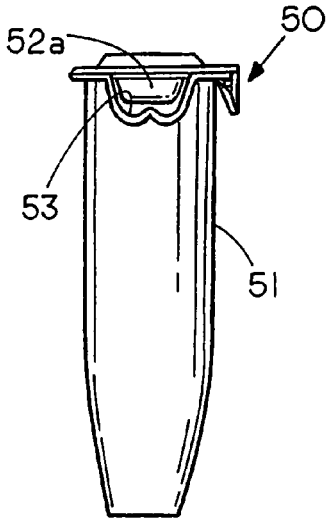
FIG. 11 is a side view of the embodiment of a direct bury splice kit of FIG. 9 in a closed condition.

FIG. 9, FIG. 10 and FIG. 11 show another example of a direct bury splice kit 50. Direct bury splice kit 50 includes a tubular housing 51 with FIG. 10 showing cover 52 in an open condition. Tubular housing 51 includes a lateral cantilevered ledge 54 and a lateral cantilevered ledge 55 that extend outwardly from opposite sides of tubular housing 51. Ledge 54 is cantilevered outward in a direction normal to a central axis of the tubular housing with an outer edge is in an unattached or free condition while ledge 55 is also cantilevered outward in a direction normal to a central axis of the tubular housing 51 with an outer edge having the cover 52 secured thereto through a living hinge 56.

Cover 52, which is similar to cover 12, includes a first square dome shaped compressible jaw 54*a* and a second dome square shaped compressible jaw 52*a* which are integrally formed as a bubble or protrusion in cover 52. Cover 52 and tubular housing 51 are made from an electrically insulating material such as a polymer plastic. In the example shown a living hinge 56 connects cover 52 to ledge 55 to allow pivoting the cover 52 from an open condition shown in FIG. 10 to a closed condition shown in FIG. 11. Although shown as a square dome shaped compressible jaw it is envisioned that other shape jaws including rigid jaws are within the spirit and scope of the invention.

Extending between one side of ledge 54 and ledge 55 is a first wire cradle 53 and located on the opposite side of tubular housing 51 and extending between ledge 54 and ledge 56 is a second wire cradle 53*a*. Wire cradle 53 and wire cradle 53*a* have a "w" shape to form side by side channels to accommodate two separate wires, however, wire cradle 53 or wire cradle 53*a* may contain more or less channels without departing from the spirit and scope of the invention.

In the example in FIGS. 9-11 the wire cradle 53 forms an integral jaw for supporting an underside of a wire and similarly wire cradle 53*a* forms an integral jaw for supporting an underside of a wire located therein. In contrast to the protruding jaws of the examples of direct bury kit 10 and direct bury kit 40 the lower portion of wire cradle 53 forms a first integral jaw for supporting an underside of a wire therein and the lower portion of wire cradle 53*a* forms an integral jaw for supporting an underside of a wire therein. The formation of the jaw as part of the wire cradle has the advantage of having the jaw that can both clamp a wire therein as well as prevent laterally displacement of the wire during the clamping process.

FIG. 9 shows that compressible jaw 52*a* is positioned to one side of cover 52 so that when cover 52 is brought into a closed condition, as shown in FIG. 11, the compressible jaw 52*a* and the jaw formed by wire cradle 53 are aligned with each other to enable the compressible jaw 52*a* and wire cradle 53 to clamp a wire therebetween.

Similarly, FIG. 9 shows that compressible jaw 54*a* is positioned on the opposite side of cover 52 so that when cover 52 is brought into a closed condition, as shown in FIG. 11, the compressible jaw 54*a* and the jaw formed by wire cradle 53*a* are aligned with each other to enable the compressible jaw 54*a* and wire cradle 53 to clamp a wire therebetween.

While two wire cradles are shown it is envisioned that more or less wire cradles may be used without departing from the spirit and scope of the invention.

In the examples shown the twist-on wire connector is a separate component of the direct bury kit. If desired the twist-on wire connector can be made as an integral portion of the tubular housing as illustrated in my U.S. Pat. No. 7,170,005 which is hereby incorporated by reference.

We claim:

1. A direct bury wire kit for waterproofing an electrical connection therein comprising:

an elongated housing having a chamber therein;

a twist-on wire connector located in said chamber;

a ledge extending outward from said housing;

a first wire jaw integral to said elongated housing;

a second wire jaw jaw integral to said elongated housing;

a cover, said cover joinable to said housing;

a latch for securing said cover to said housing;

a first resiliently deformable jaw extending from one side of said cover;

a second resiliently deformable jaw extending from an opposite side of said cover with said second deformable jaw laterally spaced from said first deformable jaw so that when said cover is brought to a closed condition said first deformable jaw and said first wire jaw form a wire clamp for frictionally securing a wire therein and said second deformable jaw and said second wire jaw form a further wire clamp for frictionally securing another wire therein.

2. The direct bury wire kit of claim 1 wherein said first wire jaw and said second wire jaw are located below a top surface of the ledge of said elongated housing.

3. The direct bury wire kit of claim 2 wherein the first deformable jaw is in alignment with said first wire jaw and the second deformable jaw is in alignment with said second wire jaw.

4. The direct bury wire kit of claim 3 wherein the first jaw comprises a first transverse rib and the second jaw comprises a second transverse rib.

5. The direct bury wire kit of claim 3 including a first wire cradle located on one side of said housing and a second wire cradle located on the opposite side of said housing.

6. The direct bury wire kit of claim 5 wherein the first wire cradle and the second wire cradle each have a channel for at least two wires.

7. The direct bury wire kit of claim 6 wherein the first resiliently deformable jaw and the second resiliently deformable jaw each have at least one open side.

8. The direct bury wire kit of claim 3 wherein the elongated housing includes a sealant encapsulating an open end of the twist-on wire connector.

9. A direct bury wire kit comprising:

a housing having a chamber therein for receiving a wire connector;

a sealant for encapsulating an electrical wire connection in the wire connector;

a first wire jaw extending laterally from a side of the housing;

a cover, said cover securable to said housing; and a second wire jaw extending from said cover so that when said cover is brought to a closed condition said second wire jaw and said first wire jaw clamp a wire therebetween, wherein the first wire jaw and second wire jaw are resiliently deformable and at least one wire jaw comprises a bubble having at least one open side.

10. The direct bury kit of claim 9 wherein the first wire jaw comprises a first wire cradle and the housing includes a third wire jaw comprising a second wire cradle.

11. The direct bury kit of claim 9 wherein the first wire jaw comprises a transverse rigid rib located in a first wire cradle and a third wire jaw comprises a transverse rigid rib located in a second wire cradle.

12. The direct bury kit of claim 10 wherein the cover includes a fourth jaw with said fourth jaw in alignment with said third jaw on said housing so that when the cover is brought into a closed condition a further wire is clamped between said fourth wire jaw and said third wire jaw.

13. The direct bury kit of claim 9 where the first wire jaw is located in a wire cradle.

14. The direct bury kit of claim 9 including a first wire cradle extending at an acute angle to the housing and a second wire cradle extending at an acute angle to the housing.

15. The direct bury kit of claim 9 including a twist-on wire connector located in the housing and the sealant encapsulating the twist-on wire connector to form a waterproof covering over an electrical connection therein.

16. The direct bury kit of claim 9 including a first wire cradle for restraining laterally movement of a wire therein and a second wire cradle located diagonally opposite of said first wire cradle for laterally restraining movement of a different wire located therein.

17. The direct bury kit of claim 9 wherein the cover and the housing are one piece with the first wire jaw integral to the housing and the second wire jaw integral to the cover.

18. A method of making a direct bury electrical connection that inhibits or prevents disruption of an electrical connection comprising:

joining an end of each of a set of electrical wires in a twist-on electrical wire connector;

encapsulating the twist-on electrical wire connector in an open-end tube containing a sealant while extending the set of electrical wires out of the tube;

bending the wires into a wire cradle extending laterally outward from the tube containing the sealant;

engaging an underside of each of the wires in a portion of the wires that are located in the wire cradle with a first resiliently deformable wire jaw located thereunder and a topside of each of the wires with a second resiliently deformable wire jaw; and clamping the portion of the wires that are located in the wire cradle between the first and the second resiliently deformable jaws located on opposite sides thereof to thereby inhibit or prevent disruption of an electrical connection in the electrical wire connector while maintaining the electrical connection in a waterproof condition wherein the first and the second resiliently deformable jaws have at least one open side.

* * * * *